United States Patent [19]

Deltoer

[11] Patent Number: 4,866,220

[45] Date of Patent: Sep. 12, 1989

[54] ELECTRIC SWITCH WITH INTEGRATED CONNECTOR

[76] Inventor: Marcel H. Deltoer, 19, Boulevard Carnot, F-92340 Bourg-la-Reine, France

[21] Appl. No.: 180,927

[22] Filed: Apr. 13, 1988

[30] Foreign Application Priority Data

Apr. 14, 1987 [FR] France ..... 87 05262

[51] Int. Cl.[4] ..... H01H 19/56

[52] U.S. Cl. ..... 200/11 A; 200/14; 200/307

[58] Field of Search ..... 200/11 R, 11 A, 11 B, 200/11 C, 11 D, 11 DA, 11 E, 11 EA, 11 G, 11 H, 11 J, 11 K, 11 TC, 11 TW, 307, 8 A, 26, 14

[56] References Cited

U.S. PATENT DOCUMENTS

| | | | |
|---|---|---|---|
| 933,956 | 9/1909 | Buffehr | 200/8 A |
| 2,644,045 | 6/1953 | Herterick | 200/14 X |
| 3,200,208 | 8/1965 | Mastney | 200/6 R |

FOREIGN PATENT DOCUMENTS

| | | |
|---|---|---|
| 0088014 | 2/1982 | European Pat. Off. . |
| 1145695 | 3/1963 | Fed. Rep. of Germany . |
| 2031898 | 11/1970 | France . |
| 1158096 | 7/1969 | United Kingdom . |

*Primary Examiner*—A. D. Pellinen
*Assistant Examiner*—Morris Ginsburg
*Attorney, Agent, or Firm*—Armstrong, Nikaido, Marmelstein, Kubovcik & Murray

[57] ABSTRACT

An electric switch including a stator with a plurality of contact studs, a shaft moving inside the stator and having at least one contact stud cooperting with the studs of the stator and a connector comprising a plurality of juxtaposed pins with each pin connected to one of the contact studs of the stator. The connector is fixed against the stator, the pins being disposed at the periphery of the connector so that they surround the stator with each pin extending along the stator and the arrangement of the studs on the stator and that of the pins on the connector is such that one end of each pin faces the corresponding stud and is fixed thereto.

6 Claims, 3 Drawing Sheets

ELECTRIC SWITCH WITH INTEGRATED CONNECTOR

BACKGROUND OF THE INVENTION

The invention relates to an electric switch including a stator having a plurality of contact studs spaced apart over its external surface, each stud passing through the stator and emerging on its inner surface, a shaft adapted so as to move inside the stator and having at least one contact stud adapted for cooperating with the studs of the stator, and a connector comprising a pin holder and a plurality of juxtaposed pins, each pin having a front portion adapted for receiving a mating pin connected to the device to be operated by the switch and a rear portion by which it is connected to one of said contact studs of the stator.

The invention relates more particularly to a switch of this kind used in the low current field (0.5 to 3 amps) for controlling a large number of electric functions. For this it includes a fairly large number of connection pins, for example 20 or so.

In the prior technique, the connector is a standard commercial product which is fixed close to the stator on an appropriate support. Each connector pin is connected to one of the contact studs of the stator by means of a flexible connecting wire, soldered by one end to the pin and by the other to the contact stud.

When such a switch is intended to equip sophisticated equipment, such as equipment carried on board an aircraft, reliability thereof is the main concern. Now, the presence of a large number of soldered points increases the risk of failure of the switch. Similarly, the flexibility of the connection wires risk being the seat of vibrations which may lead to their breakage.

Unexpectedly, the applicant has envisaged designing a connector whose arrangement is specific and adapted to the type of switch considered which of course means that as many different connectors must be provided as there are different switches to be equipped. This solution, at first sight costly, proves to be economically satisfactory, as will be described hereafter.

The applicant has discovered that, by modifying the traditional arrangement of the contact studs of the stator and those of the connector pins, it is possible to provide a direct correspondence between the studs and the pins.

SUMMARY OF THE INVENTION

The invention relates then to a switch of the type mentioned at the beginning, wherein the connector is fixed against one end of the stator, the pins being disposed at the periphery of the connector so that they may surround the stator, each plug extending along the stator, the arrangement of the studs on the stator and that of the pins on the connector being such that one end of the rear portion of each pin faces the corresponding stud and is fixed thereto.

Advantageously, the pins are disposed on the pin holder at several different distances with respect to the switch shaft, the contact studs of the stator extending transversally outside the shaft in several different lengths.

Advantageously, the contact studs of the stator are spaced apart therealong, the pins extending outside the connector by their rear portion in several different lengths.

In a preferred embodiment, the front portion of each pin is enclosed in a housing of the connector opening into a face thereof opposite the stator, means being provided in each housing for retaining another pin connected to said pin, and sealing the connection thus formed.

Advantageously, the connector and the stator have, in cross section, external shapes similar to each other.

Advantageously, each pin is soldered to the corresponding stud.

BRIEF DESCRIPTION OF THE DRAWINGS

Other details and advantages of the invention will appear during the following description of two preferred embodiments of the invention given by way of non limitative examples, with reference to the accompanying drawings in which.

DESCRIPTION OF THE PREFERRED EMBODIMENTS

Figure 1:
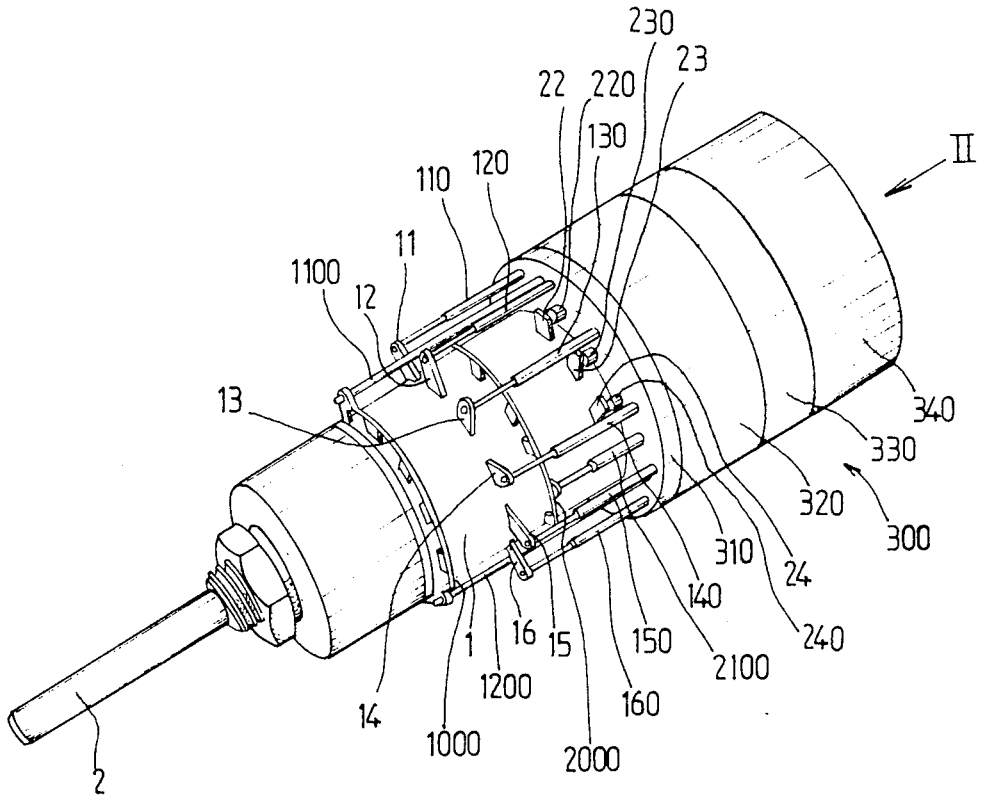
FIG. 1 is a perspective view of an electric switch in a first embodiment.

The electric switch shown in FIG. 1 includes a tubular stator 1 made from an electrically insulating material carrying a plurality of rigid metal contact studs. In this example, two input studs 1000, 2000 are shown in the form of a ring extending in a plane perpendicular to the axis 3 of the switch and projecting from the external surface of stator 1. Each ring has a plurality of lugs, some of which 1001, 1002 are visible in FIG. 3, which pass through the stator through its thickness and are adapted for cooperating with a mobile contact member 600, for example a contact blade, carried by a rotor formed here by an operating shaft 2, via an insulating socket 601. Two groups of output studs are further shown, each group including 10 independent studs disposed in the ring in the same plane perpendicular to the axis of the rotor. Each stud such as 11 extends radially so as to pass through the stator through its thickness, it emerges on the one hand, at the inner surface of the stator for cooperating with the corresponding mobile contact member 600 of the rotor, and, on the other hand, at its external surface.

In FIG. 1, the output studs 11 to 16 are more particularly shown which are intended to be connected to the input stud 1000 by means of the mobile contact member 600 of the rotor, as well as the output studs 22 to 24 intended to be connected to the input stud 2000 by means of a second mobile contact member of the rotor.

For further details concerning the arrangement and the operation of such a switch, reference may be made more particularly to French patent No. 1 398 866 in the name of the applicant.

The switch includes a connector 300 for removably connecting each of the contact studs to an electric device to be controlled. In accordance with the invention, this connector is adapted so as to be applied and fixed directly against the rear end of stator 1 opposite shaft 2.

In the present case, this connector is a pin holder comprising 24 pins or rigid metal male elements adapted for receiving female sockets of the "GAUGE 22" type in accordance with the American standard MIL-C-39029/56.

Figure 3:
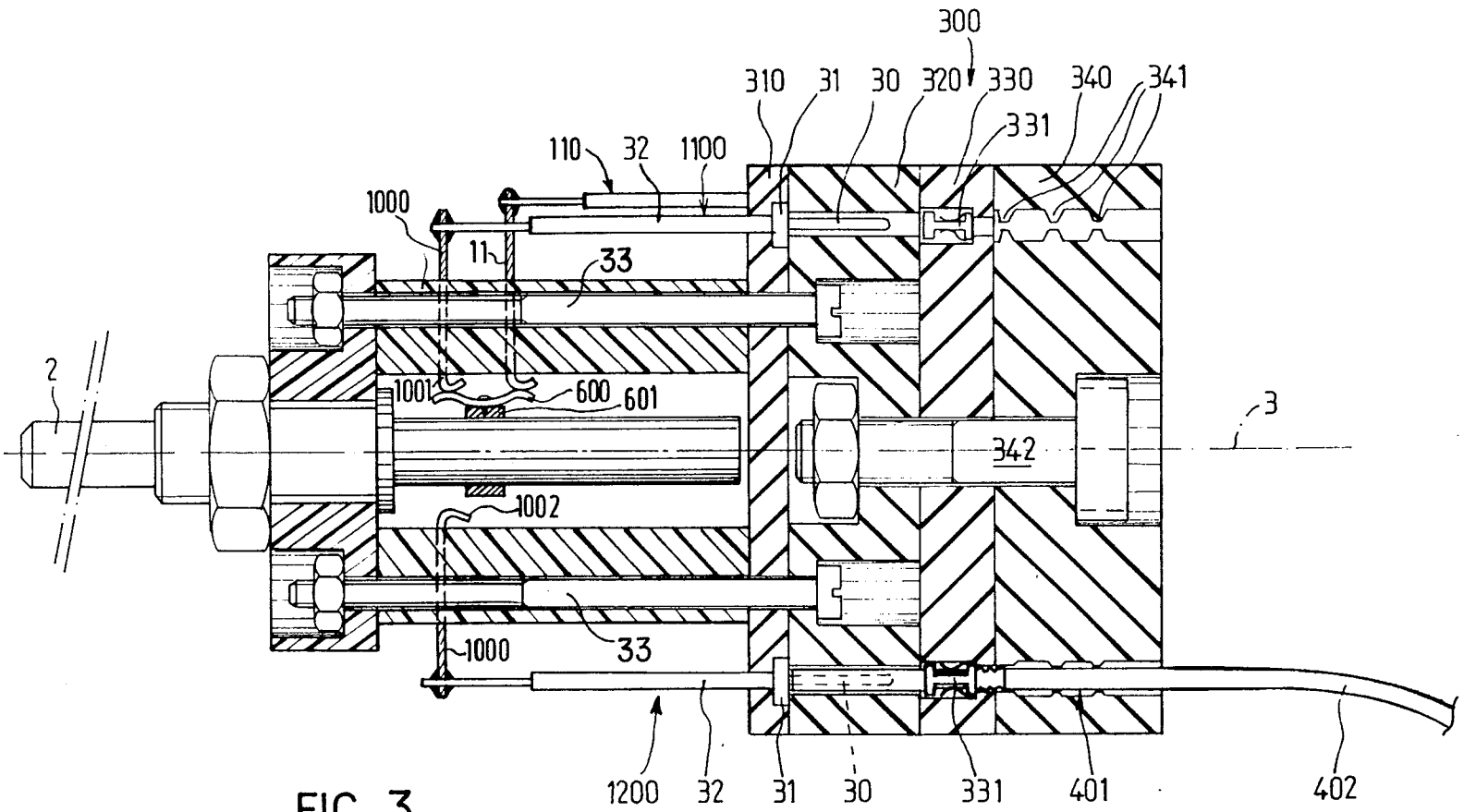
FIG. 3 is a cross sectional view of the switch through line III—III of FIG. 2.

In FIG. 3, each male pin 1100, 1200 has a front portion 30 adapted for cooperating with a socket, a collar 31 situated in a middle region for axially immobilizing same and a rear portion 32 whose length is chosen so as to be able to be fixed to the input stud 1000. Such fixing is here provided by soldering, but could also be provided by any other means such as crimping. The two male pins 1100, 1200 are disposed about stator 1 and extend parallel to its longitudinal axis 3.

The pin holder 300 is formed of four juxtaposed disks 310 to 340 coaxial with stator 1 and having 24 through holes for housing the male pins and female sockets, the three disks 310, 320, 330 are made from DIAL (diallylphtalate reinforced with glass at 35%), and disk 340 is made from a silicon based elastomer of different color. Collar 31 of each of the male pins 1100, 1200 is imprisoned between the two disks 310, 320, which are held applied against the rear end of stator 1 by two bolts 33 passing longitudinally through the stator.

The third disk 330 is adapted for fixedly housing sleeves 331 known per se and adapted for locking the female sockets against translation when they are completely inserted in the plug holder 300 and cover the front portions 30 of the corresponding male pins. In FIG. 3, the female socket 401 is shown in the position inserted on the male pin 1200. Each female socket 401 is crimped on a flexible connecting wire 402.

The fourth disk 340 has through holes provided with three flexible nipping rings 341 for sealingly cooperating with the connecting wires 402. The sealing obtained by disk 340 is ensured up to a pressure of 2 bars.

Disk 330 and 340 are held applied against disk 320 by means of an axial bolt 342.

Referring to FIG. 1, it will be noted that the rear portion of each male pin has a length adapted to the distance separating the pin holder 300 from the stud to which this rear portion is to be fixed. Here four different lengths are shown: that of pins 1100 and 1200 fixed to the input stud 1000, that of pins 110 to 160 fixed respectively to the output studs 11 to 16, that of pin 2100 fixed to the input stud 2000 and that of pins 220 to 240 fixed respectively to the output studs 22 to 24. As for the front portions of the different male pins, they all have the same length and the same axial position.

Figure 2:
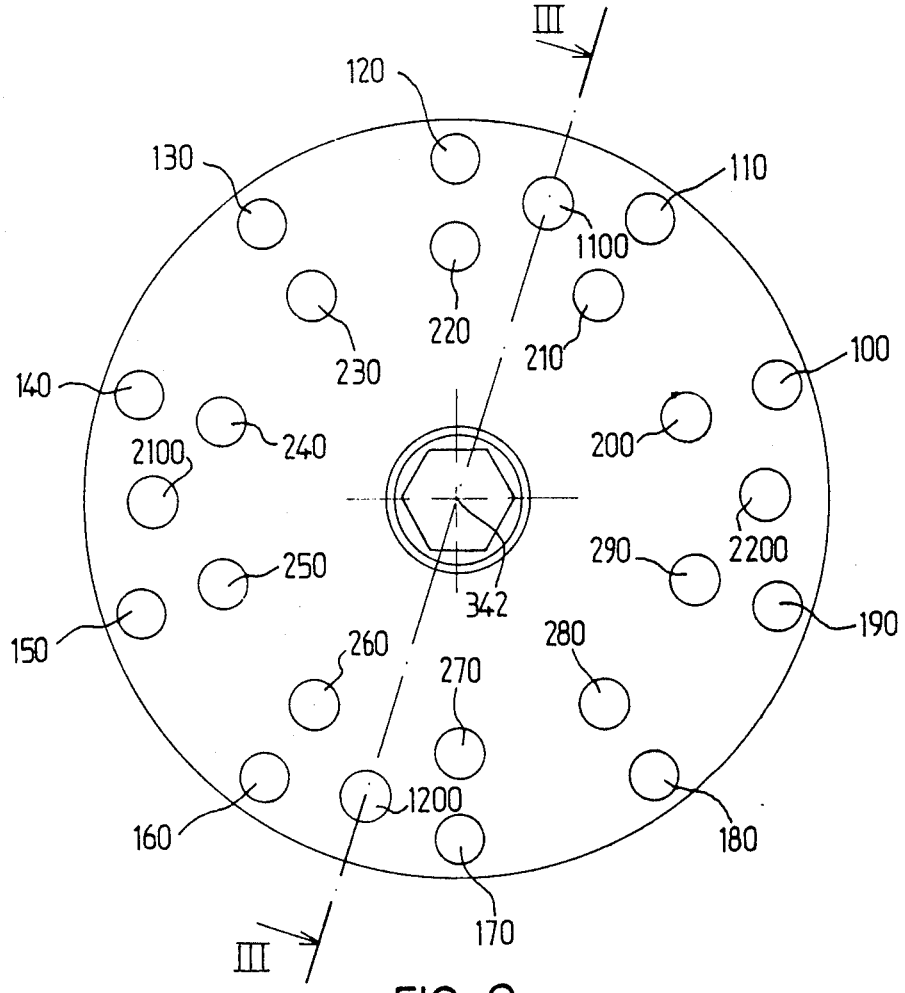
FIG. 2 is a rear view of the switch in the direction of arrow II of FIG. 1.

Referring to FIG. 2, the through holes of the pin holder have been given signs referring to the corresponding male pins. It will be noted that the male pins are disposed exclusively at the periphery of the pin holder, in several concentric circles whose center is disposed along the axis of the stator. The shortest male pins 200 to 290 are disposed in a circle of smaller radius, male pins 100 to 190 being disposed in a circle of larger radius and male pins 1100, 1200, 2100, 2200, being disposed in a circle of intermediate radius. Naturally, the input and output studs extend radially outside the stator over a length adapted to the radial position of the corresponding male pins.

In accordance with the invention, a switch with pin holder has been provided free of any internal connecting wire and comprising only one soldering point per connection, instead of two in the prior technique. This switch has then substantially increased reliability.

Furthermore, the absence of connecting wires internally of the switch has considerable influence on the cost price of the switch; In known switches, the connecting wires have to be spaced apart about the switch and have to be held: these operations require a fairly qualified staff and are time consuming. For manufacturing the switch of the invention, time is thus saved and a less qualified work force may be used, so that the cost price of the switch is finally substantially less than that of the known switch.

By way of example, some dimensions are given hereafter relative to the switch described. The mean diameter of the male pins is of the order of a millimeter, whereas their mutual spacing varies approximately between 1 and 4 mm. Moreover, the outer diameter of the pin holder, is equal to about 25 mm.

The invention is applicable to different types of switches having a specific arrangement of the contact studs, particularly to a switch in which the rotor is a screw cooperating with carrier shoes of a mobile circuit, these shoes moving along the axis of this switch, such as described in French patent No. 2 031 898. Here, the studs of a group of output studs considered carried by the stator are not disposed in a ring in the same transverse plane as in FIG. 1, but are bars extending perpendicularly to the axis of the switch, which are spaced apart along the axis of the switch in the manner of the teeth of a comb.

Figure 4:
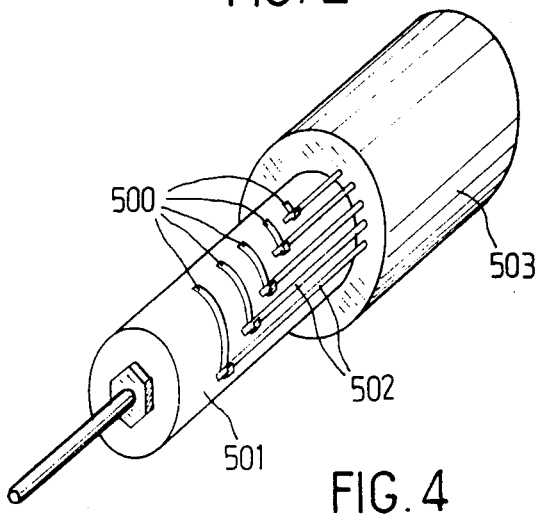
FIG. 4 is a perspective view of an electric switch in a second embodiment.

FIG. 4 shows such a switch adapted to the invention in which bars 500 are of variable length and extend along the outer surface of stator 501. The male pins 502 spaced apart at the periphery of a pin holder 503 fixed to stator 501 themselves have variable lengths. The free end of each bar is rolled about the facing end of the corresponding male pin and may be soldered thereto.

In the above described switches, although the connector and the stator have a circular shape in cross section, other shapes may of course be contemplated such as a square or hexagonal shape, depending more particularly on the space problems. The spacing apart of the male pins at the periphery of the pin holder will in all cases be adapted to the shape of the connector and of the stator.

What is claimed is:

1. An electric switch comprising:

a tubular stator having a plurality of contact studs spaced axially and circumferentially over its external surface, each stud passing through the stator and emerging on its inner surface;

a shaft mounted for movement internally of the stator and having at least one contact stud positioned to engage at least one pair of the studs of the stator upon movement of said shaft;

and a connector comprising a pin holder and a plurality of juxtaposed pins, each pin having a front portion for receiving another pin and a rear portion by which it is connected to one of said contact studs of the stator, said connector is fixed against one end of the stator, the pins being disposed at the periphery of the connector so that they surround the stator, each pin extending along the stator, the arrangement of the studs on the stator and the arrangement of corresponding pins on the connector being such that one end of the rear portion of each pin faces a corresponding stud and is fixed thereto.

2. The switch as claimed in claim 1, wherein at least certain ones of the pins are disposed on the pin holder at several different radial distances with respect to the shaft and the contact studs of the stator extend transversely outside the stator in several different lengths.

3. The switch as claimed in claim 1, wherein the contact studs of the stator are spaced apart along the length of the stator and the pins extend outside the connector by their rear portion in several different lengths.

4. The switch as claimed in claim 1, wherein said connector is comprised of an assembly of stacked plates abutting said one end of the stator, the front portion of each pin is enclosed in an opening into a face of one of said plates opposite the stator and further including means provided in said connector for retaining a mating pin connected to said front portion of each said pin and sealing the connection thus formed.

5. The switch as claimed in claim 1, wherein the connector and the stator have, in cross section, external shapes similar to each other.

6. The switch as claimed in claim 1, wherein each pin is soldered to the corresponding stud.

* * * * *